US005848690A

United States Patent [19]

Granger et al.

[11] Patent Number: 5,848,690

[45] Date of Patent: Dec. 15, 1998

[54] TENNIS BALL CONTAINER WITH PRESSURE SEAL AND SCREW-ON CAP

[75] Inventors: Bryce C. Granger; Michael A. Soltis, both of Simpsonville, S.C.

[73] Assignee: Wilson Sporting Goods Co., Chicago, Ill.

[21] Appl. No.: 736,570

[22] Filed: Oct. 24, 1996

[51] Int. Cl.[6] ..... B65D 41/20

[52] U.S. Cl. ..... 206/315.9; 220/278

[58] Field of Search ..... 206/315.1, 315.9; 220/278, 277, 265, 260; 215/215, 250, 257

[56] References Cited

U.S. PATENT DOCUMENTS

| | | | |
|---|---|---|---|
| 2,102,158 | 12/1937 | Keaney . | |
| 2,355,108 | 8/1944 | Reese . | |
| 2,712,394 | 7/1955 | Koschatzky . | |
| 3,074,592 | 1/1963 | Stocking | 220/278 |
| 3,187,918 | 6/1965 | Moore | 220/277 X |
| 3,581,881 | 6/1971 | Hobbs . | |
| 3,819,040 | 6/1974 | Coons . | |
| 3,853,222 | 12/1974 | Helms . | |
| 3,888,347 | 6/1975 | Kramer . | |
| 3,897,874 | 8/1975 | Coons . | |
| 4,019,629 | 4/1977 | Dubner . | |
| 4,161,247 | 7/1979 | Feinberg . | |
| 4,428,478 | 1/1984 | Hoffman . | |
| 4,770,305 | 9/1988 | Su | 220/278 X |
| 5,082,136 | 1/1992 | Schumann . | |
| 5,161,707 | 11/1992 | Dutt . | |
| 5,255,813 | 10/1993 | Berggren et al. | 220/278 |
| 5,273,171 | 12/1993 | Steele-Rowland et al. | 220/278 X |

*Primary Examiner*—Jacob K. Ackun

[57] ABSTRACT

A tennis ball container assembly includes a generally cylindrical container having an open top end, a membrane seal which is secured to the open end of the container for holding pressurized gas in the container, and a cap which is screwed onto the top of the container. The cap includes a flexible portion and a prong on the flexible portion for piercing the membrane seal when the flexible portion is pushed downwardly toward the seal. After the internal pressure in the container is vented, the cap can be unscrewed.

7 Claims, 3 Drawing Sheets

TENNIS BALL CONTAINER WITH PRESSURE SEAL AND SCREW-ON CAP

BACKGROUND

This invention relates to tennis ball containers, and, more particularly, to a tennis ball container having a membrane seal for maintaining internal pressure in the container and a screw-on cap.

Tennis balls conventionally include a hollow rubber core and a felt cover. When the balls are manufactured, the core is pressurized with air or other gas to an internal pressure of about 14 psi gauge. Since the pressurized gas will leak through the rubber core, new tennis balls are packaged in a sealed, pressurized container. The pressure inside of the container is approximately the same as the pressure inside of the tennis ball.

Most tennis ball containers are formed from a cylindrical metal or plastic can or container which is closed by a peel-off metal lid. The can is opened by lifting a tab on the lid and pulling the tab away from the can. The lid is thrown away, and a snap-on plastic cover is used to cover the open top of the can. The metal lid is relatively rigid and sharp, and proper disposal of the lid is important.

Attempts have been made to provide tennis ball containers with screw-on caps which can be removed and replaced. For example, U.S. Pat. Nos. 3,819,040 and 3,897,874 describe tennis ball containers in which a seal is provided between the container and a screw-on cap by an O-ring on the container. However, we believe that a screw-on cap does not provide a satisfactory seal for the internal pressure in the container.

SUMMARY OF THE INVENTION

The invention provides a tennis ball container with a membrane seal and a screw-on cap. The container includes a cylindrical side wall having an open top, and a metal foil seal is secured to the top to seal the container. A screw-on cap is threadedly engaged with the top of the container. The cap includes a top wall having a flexible portion and a prong on the bottom of the flexible portion. The seal is punctured before the cap is unscrewed by pushing the flexible portion and the prong downwardly, thereby relieving the internal pressure in the container. The cap is then unscrewed, and the metal foil seal can be peeled away from the container and discarded. If desired, the top wall of the cap can be provided with a ripper tooth for puncturing and/or tearing the seal if the cap is unscrewed without first depressing the flexible portion of the cap.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
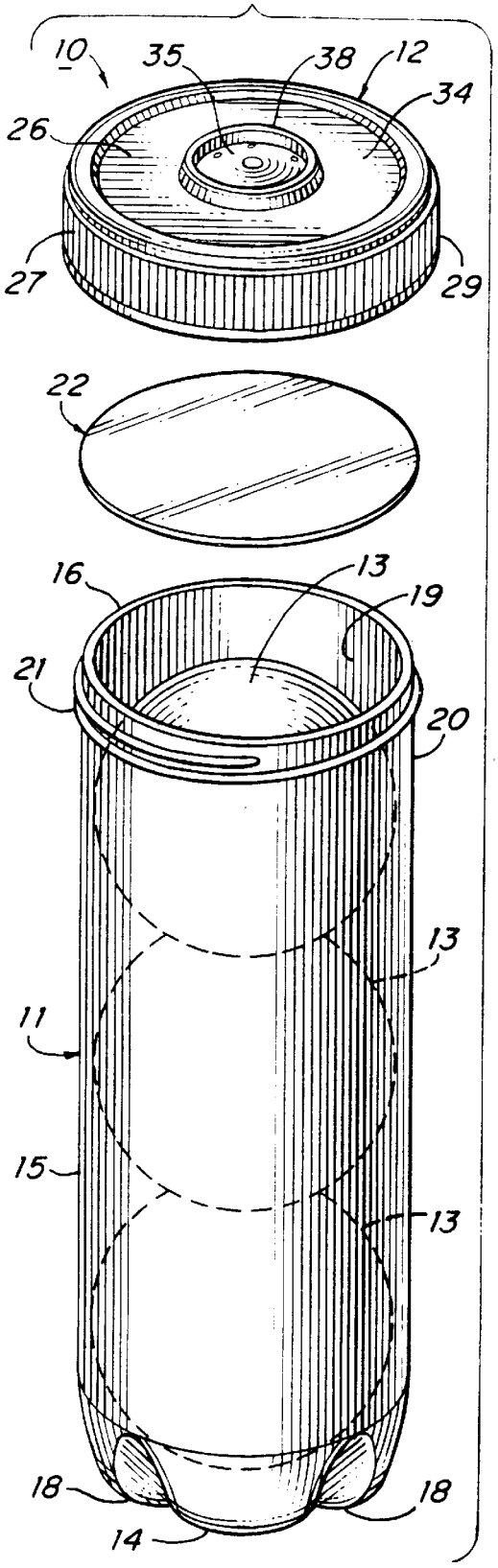
FIG. 1 is an exploded view of a tennis ball container assembly formed in accordance with the invention.
Figure 2:
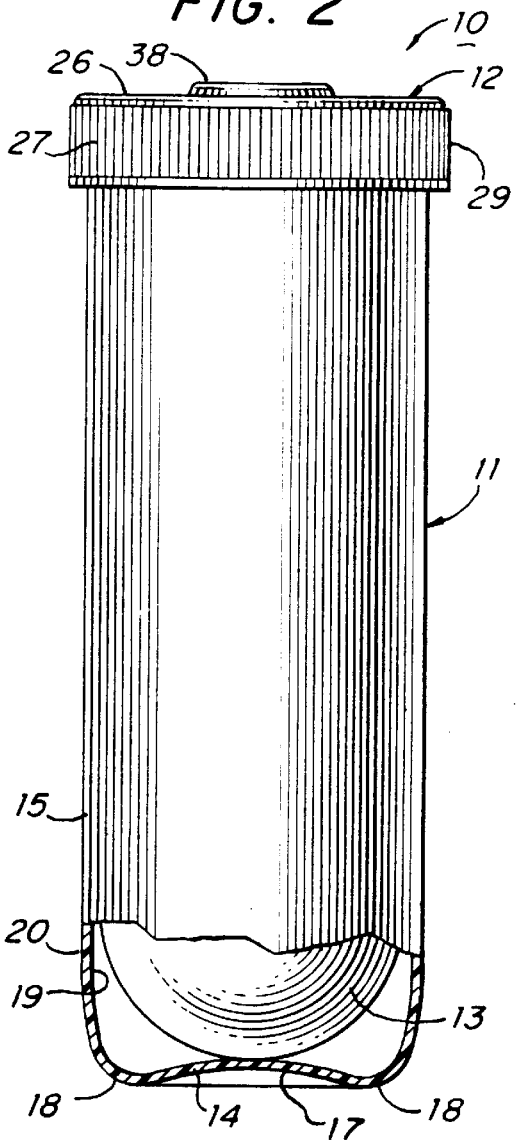
FIG. 2 is an elevational view, partially broken away, of the tennis ball container.

Referring to FIGS. 1 and 2, a tennis ball container assembly 10 includes a container 11 and a cap 12. The container holds three tennis balls 13. The container is preferably molded from plastic such as PETE and includes a base or bottom wall 14, a generally cylindrical side wall 15, and an open top end 16. The bottom wall may be provided with a dome-shaped portion 17 for reinforcement and support feet 18. The cylindrical side wall includes inner and outer surfaces 19 and 20, and external male threads 21 are provided on the outer surface near the top of the container.

Figure 8:
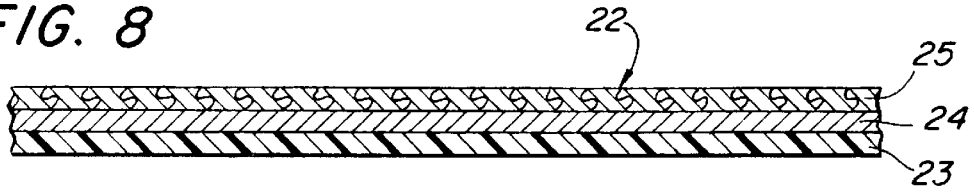
FIG. 8 is an enlarged fragmentary sectional view of the membrane seal.

A thin membrane seal 22 (FIG. 9) is secured to the top end of the container for closing the top end and sealing the internal pressure in the container. In the specific embodiment illustrated in FIG. 8, the seal 22 is formed from a bottom layer 23 of plastic, an intermediate layer 24 of aluminum foil, and a top paper layer 25. The layers are laminated together to form an integral membrane seal having a total thickness of about 0.007 inch. The seal is secured to the top of the container by heating the seal with an inductance heater. The plastic layer 23 is heated by the aluminum 24 and fuses to the top of the plastic container. The material of the plastic layer is compatible with fusion bonding to the container.

Figure 3:
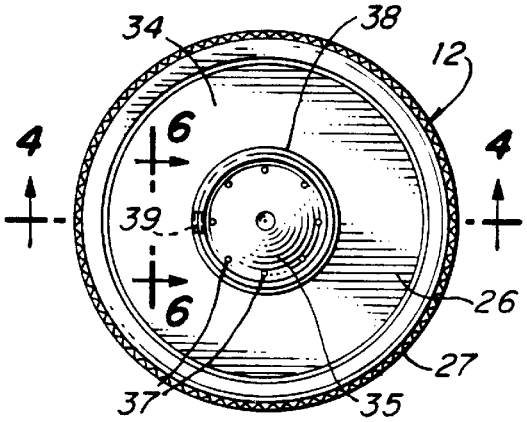
FIG. 3 is a top plan view of the container assembly.
Figure 4:
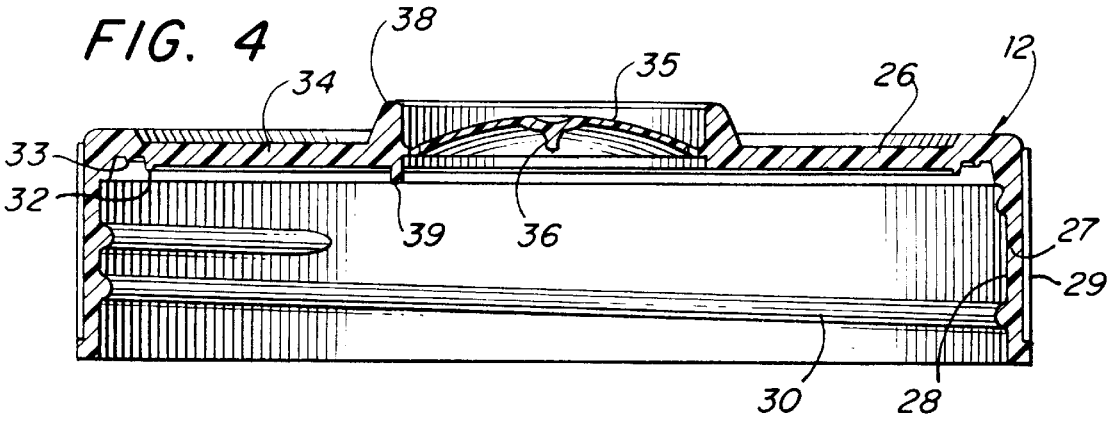
FIG. 4 is a fragmentary sectional view taken along the line 4—4 of FIG. 3.
Figure 5:
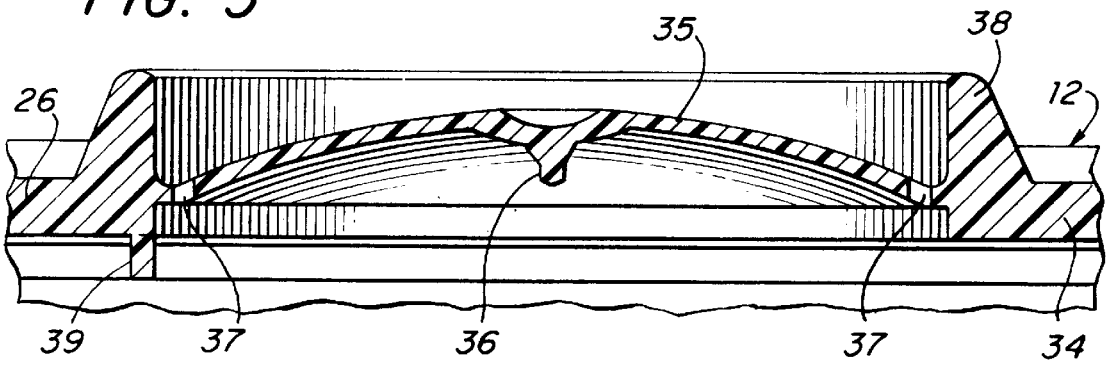
FIG. 5 is an enlarged fragmentary view of a portion of FIG. 4.

The cap 12 may be molded from plastic such as polypropylene. Referring to FIGS. 3 and 4, the cap includes a top wall 26 and a generally cylindrical side wall 27. The side wall includes inner and outer surfaces 28 and 29 (FIG. 4), and internal female threads 30 are provided on the inner surface near the top wall.

Figure 7:
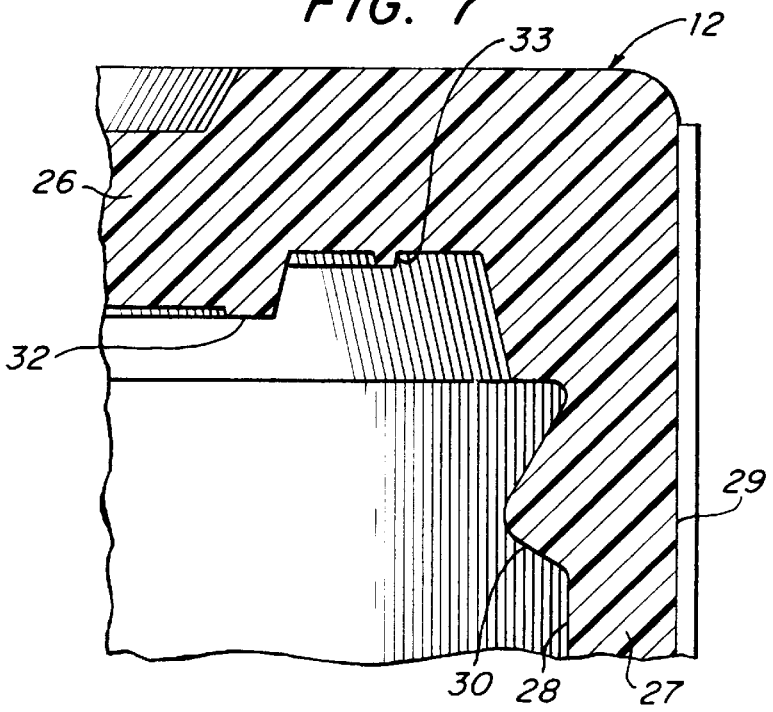
FIG. 7 is an enlarged sectional view of a portion of FIG. 4.
Figure 9:
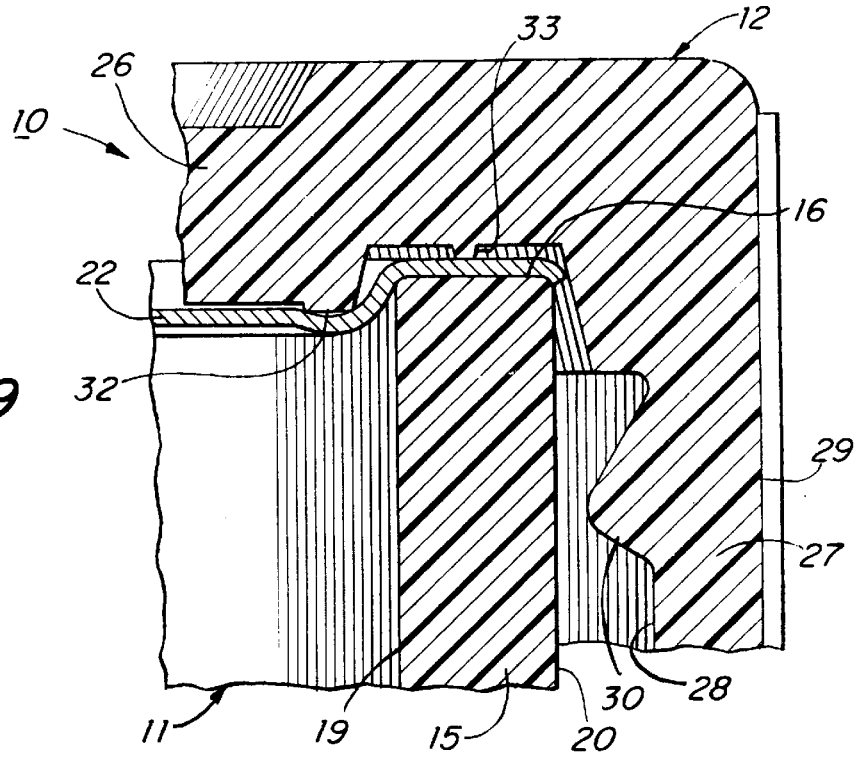
FIG. 9 is an enlarged fragmentary sectional view showing the engagement between a portion of the membrane seal and the cap.
Figure 10:
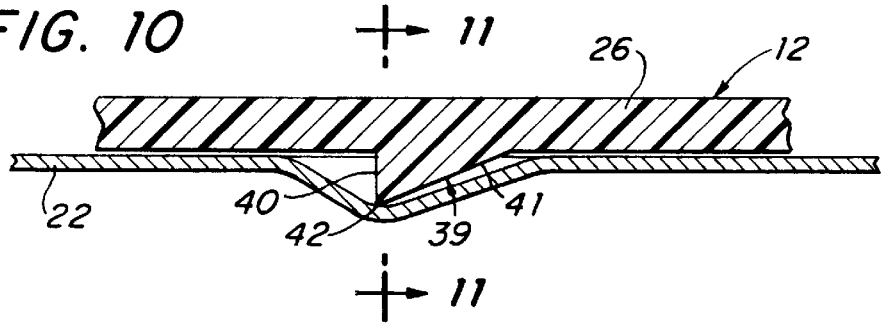
FIGS. 10 and 11 are enlarged fragmentary sectional views showing the engagement between the membrane seal and the ripper tooth.
Figure 11:
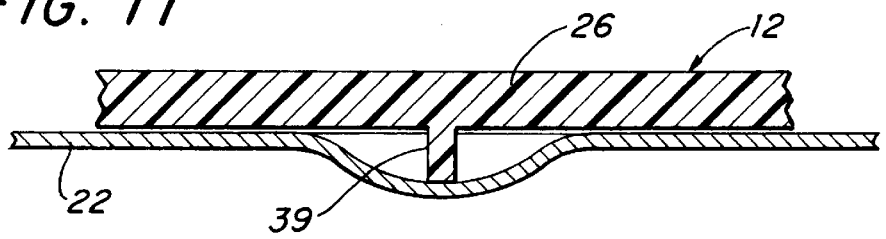

An annular flange 32 (FIG. 7) extends downwardly from the bottom surface of the cap 12. When the cap is screwed onto the container, the flange 32 engages the seal 22 and forces the seal downwardly below the top edge of the container and alongside the inner surface of the container as shown in FIG. 9. Another annular flange 33 on the cap is positioned radially outwardly of the flange 32 and presses against the portion of the seal which is fused to the top edge of the container. The combination of the cap butting against the fused portion of the seal and the flange 32 forcing the seal downwardly increases the reliability of the seal and minimizes the possibility that internal pressure within the container will escape.

The top wall of the cap includes a substantially flat annular outer portion 34 and a flexible plunger portion 35. The flexible portion 35 is dome-shaped and curves upwardly from the bottom surface of the top wall of the cap. The flexible portion 35 can be molded integrally with the remainder of the cap, and the flexibility is achieved by molding the flexible portion 35 with a thinner cross section. A prong or tooth 36 is molded integrally in the center of the dome-shaped flexible portion 35, and the pointed bottom end of the prong 36 is slighting above the plane of the bottom surface of the top wall of the cap. A plurality of vent holes 37 (FIG.

3) are formed through the flexible portion 35 adjacent the periphery thereof. A protective rim 38 extends upwardly around the dome-shaped flexible portion.

In the particular embodiment illustrated, the cap 12 also includes a ripper tooth 39 (FIGS. 5, 6, 10, and 11) which extends downwardly from the bottom surface of the top wall 26. The ripper tooth includes a first flat surface 40 (FIG. 6) which is substantially parallel to the longitudinal centerline of the container and an inclined flat surface 41. The intersection of the flat surfaces 40 and 41 provides a sharp edge 42 which engages the membrane seal 22.

An empty container 11 is filled with three tennis balls 13, and liquid nitrogen, dry ice, or other conventional pressurizing material is placed inside of the container. The membrane seal 22 is then fused to the top end of the container with an inductance heater. The cap 12 is then screwed onto the top of the container.

The cap is screwed onto the container before the liquid nitrogen or dry ice pressurizes the interior of the container. The membrane seal 22 is flexible and is not secured in a taut manner to the top of the container. As the cap is screwed onto the container, the annular flange 32 engages the flexible seal and pushes the seal downwardly until the annular flange 33 of the cap abuts against the portion of the seal which is fused to the top end of the container. Similarly, the ripper tooth 39 pushes the flexible membrane seal downwardly without piercing the seal.

As the liquid nitrogen or dry ice evaporates, the interior of the container is pressurized. The amount of liquid nitrogen, dry ice, or other pressurizing material is selected to provide an internal pressure which is approximately the same as the internal pressure of new tennis balls, for example, 14 psi gauge. As the interior of the container is pressurized, the flexible membrane seal 22 is pushed upwardly toward the top wall of the cap. However, the internal pressure in the container is not sufficient to cause the seal 22 to be punctured by either the ripper tooth 39 or the prong 36.

The fusion bond between the seal 22 and the container provides a pressure-tight seal which maintains the desired internal pressure in the container. The seal provided by the fusion bond is reinforced or augmented by the butt contact between the annular flange 33 of the cap and the bonded portion of the seal and by the flange 32 which deforms the seal downwardly along the inside of the container.

When the purchaser of the tennis ball container wishes to use the tennis balls, he first pushes the flexible central portion 35 of the cap downwardly so that the prong 36 pierces or punctures the seal 22. When the seal is punctured, the pressurized gas within the container is vented through the vent openings 37 in the cap. The cap can then be unscrewed from the container, and the seal 22 can be removed by peeling the seal off of the top edge of the container. The punctured portion of the seal provides a convenient location for pushing a finger through the seal and tearing the seal away from the container.

The membrane seal 22 is readily deformable and can be crumpled up and conveniently disposed of after it is removed from the container. The aluminum foil layer of the membrane seal is pliable and flexible and does not present any rigid, sharp edge which could cut the user's hand or cause a hazard after disposal.

Figure 6:
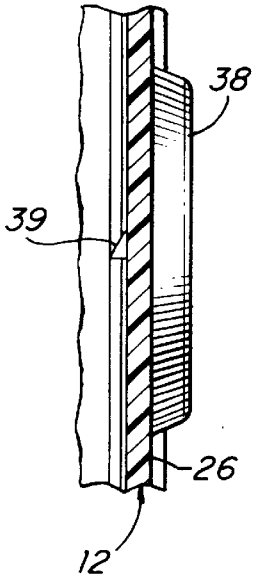
FIG. 6 is an enlarged fragmentary sectional view taken along the line 6—6 of FIG. 3.

The ripper tooth 39 is provided as a fail-safe mechanism if the user does not first puncture the seal by depressing the flexible portion 35 of the cap. As illustrated in FIG. 6, the membrane seal 22 is forced upwardly around the ripper tooth by the pressurized gas within the container. If the cap is unscrewed before the internal pressure is relieved, the ripper tooth will puncture and tear the membrane seal as the cap is rotated. The pressurized gas in the container will then be vented through the vent openings 37.

After the tennis balls are used, they can be returned to the container for storage. The top of the container is closed by screwing the cap 12 onto the top of the container.

While in the foregoing specification a detailed description of specific embodiments of the invention was set forth for the purpose of illustration, it will be understood that many of the details herein given may be varied considerably by those skilled in the art without departing from the spirit and scope of the invention.

We claim:

1. A tennis ball container assembly comprising:

a container having a bottom wall, a generally cylindrical side wall, and an open top end, the side wall of the container having an upper edge portion which includes inner and outer surfaces and a top edge, the outer surface of the side wall of the container having male screw threads thereof, a plurality of tennis balls within the container, a seal secured to the top edge of the side wall and closing the top end of the container, a cap having a top wall and a generally cylindrical side wall, the side wall of the cap having inner and outer surfaces and a bottom edge, the inner surface of the side wall of the cap having female screw threads thereon which are engageable with the male threads of the container, the top wall having a flexible portion which can be flexed toward the seal, piercing means on the flexible portion for puncturing the seal when the flexible portion is flexed toward the seal, and means for venting internal pressure in the container when the piercing means punctures the seal, and pressurized gas within the container.

2. The tennis ball container of claim 1 in which the piercing means comprises a prong which extends downwardly from the flexible portion.

3. The tennis ball container of claim 2 in which the top wall of the cap includes an annular, substantially flat outer portion, said flexible portion of the cap comprising a generally dome-shaped portion which extends upwardly from the annular outer portion.

4. The tennis ball container of claim 3 in which the piercing means comprises a prong which extends downwardly from the dome-shaped portion.

5. The tennis ball container of claim 4 in which the dome-shaped portion is provided with at least one opening for venting internal pressure in the container when the prong punctures the seal.

6. The tennis ball container of claim 1 including ripper means on the top wall of the cap which engages the seal for ripping the seal when the cap is unscrewed from the container if the seal is not punctured by the piercing means.

7. The tennis ball container of claim 1 in which the top wall of the cap includes a downwardly extending annular flange which engages the seal and forces a portion of the seal below the top edge of the container.

* * * * *